United States Patent [19]

Van de Sande et al.

[11] 4,430,421

[45] Feb. 7, 1984

[54] METHOD OF DISPERSING PHOTOGRAPHIC ADJUVANTS IN HYDROPHILIC COLLOID COMPOSITIONS

[75] Inventors: Christian C. Van de Sande, Belsele; Jan J. Vandewalle, Mortsel; Raphaël K. Van Poucke, Berchem; Andre K. Claes, Oevel, all of Belgium

[73] Assignee: Agfa-Gevaert, N.V., Mortsel, Belgium

[21] Appl. No.: 454,244

[22] Filed: Dec. 29, 1982

[30] Foreign Application Priority Data

Jan. 26, 1982 [GB] United Kingdom ..... 8202098

[51] Int. Cl.[3] ..... G03C 5/14

[52] U.S. Cl. ..... 430/377; 430/140; 430/546

[58] Field of Search ..... 430/377, 546, 140

[56] References Cited

U.S. PATENT DOCUMENTS

| | | | |
|---|---|---|---|
| 2,322,027 | 6/1943 | Jelley et al. | 430/546 |
| 2,949,360 | 7/1960 | Julian | 430/546 |
| 4,250,251 | 2/1981 | Osborn et al. | 430/140 |
| 4,326,022 | 4/1982 | Ito et al. | 430/546 |

*Primary Examiner*—J. Travis Brown

*Attorney, Agent, or Firm*—A. W. Breiner

[57] ABSTRACT

Method of dispersing photographic adjuvants in hydrophilic colloid compositions for forming a water-permeable photosensitive or non-photosensitive colloid layer of a photographic silver halide element with the aid of at least one high-boiling substantially water-insoluble oil-former of the class of dihydroxymethyl(5,2,1,$0^{2,6}$)-tricyclodecane and the carboxylic, phosphoric, or phosphonic di-ester derivatives thereof.

11 Claims, No Drawings

METHOD OF DISPERSING PHOTOGRAPHIC ADJUVANTS IN HYDROPHILIC COLLOID COMPOSITIONS

The present invention is concerned with the use of high-boiling substantially water-insoluble dihydroxymethyl-tricyclodecane or a carboxylic, phosphoric, or phosphonic di-ester derivative thereof as an oil-former in dispersing photographic adjuvants into hydrophilic colloid compositions of photosensitive or non-photosensitive layers of photographic silver halide elements used e.g. in colour photography and in integral dye sound tracks of motion picture films.

In the manufacture of a photographic silver halide element numerous adjuvants have to be brought into cooperative association in the different hydrophilic colloid layers of said photographic silver halide element. These adjuvants include all kinds of photographic couplers, dyes e.g. filter dyes, antihalation dyes, sensitizing dyes, light-screening dyes, and dye-releasing compounds; and also for example stabilizers, UV-absorbers, optical brightening agents, electron-donating agents, scavengers, and fluorescing compounds, etc.

The methods, by which such adjuvants are incorporated into the photographic colloid layers, present many problems and much effort has been made to solve these problems, particularly with regard to the incorporation of non-diffusing couplers into photographic silver halide emulsions. A coupler is any compound that in silver halide photography couples with an oxidized aromatic primary amino colour developing agent to form a dye.

For various reasons it is desirable that the chemical adjuvants, when incorporated into photographic photosensitive or non-photosensitive layers of a photographic silver halide element, remain immobile in the layer in which they have been incorporated. Colour couplers for instance should not wander nor diffuse through the photosensitive silver halide emulsion, since this may impair colour separation and result in unsatisfactory dye images.

A common method employed to render chemical adjuvants, e.g. couplers, non-diffusing in hydrophilic colloid media is to provide them in the course of their synthesis with one or more ballast groups. The presence of a ballast group imparts a hydrophobic character to the molecule and therefore such non-diffusing couplers are frequently provided with one or more salt-forming groups e.g. carboxy groups and preferably sulpho groups, so that these compounds can be dissolved in the photographic emulsions in the form of their soluble alkali salts.

However, the incorporation of these non-diffusing adjuvants containing salt-forming groups, into aqueous hydrophilic colloid compositions frequently poses a number of difficulties. For instance, some compounds are soluble only in highly alkaline solutions, which might give rise to hydrolysis of ester groups or which are too basic for use in conventional photo-sensitive silver halide elements since high pH-values cause fogging of the emulsion. A subsequent acidification step to avoid such effects brings about the formation of salts and can result in flocculation.

Alternative processes of incorporating photographic adjuvants e.g. couplers in photographic colloids make use of dispersion techniques. One of the advantages of these techniques is that couplers can be used, which are water-insoluble and contain no salt-forming groups.

According to one of said dispersion techniques the couplers are dissolved in water-immiscible, oil-type solvents or oil-formers such as tricresyl phosphate and di-n-butyl phthalate and the resulting solution is added to an aqueous phase containing gelatin and a dispersing agent e.g. a higher fatty alcohol sulphate. The mixture is then passed through a homogenizing apparatus wherein is formed a dispersion of the oily coupler solution in an aqueous medium. In some cases the dissolution of the coupler in the oil-former is facilitated by the use of an auxiliary low-boiling water-immiscible solvent, which is removed afterwards by evaporation. The above dispersion of coupler is then mixed with a gelatin silver halide emulsion and coated in the usual manner to produce a system in which particles of coupler, surrounded by an oily membrane, are distributed throughout the gel matrix.

In this dispersion technique difficulties are sometimes encountered in that the coupler, owing to the limited solvent action of the oil-former used, has the tendency to crystallize in the emulsion. This crystallization of the coupler is undesirable because the coupler reacts less readily in the color-forming reaction when crystalline and therefore yields less dye. Another difficulty sometimes encountered in this dispersion technique is that this procedure does not always produce dispersions of sufficiently small particle size with the result that the sharpness of the photographic image is adversely affected. Moreover, certain oil-formers may impair the storage properties of the photosensitive emulsion layer. Another problem is that the photographic adjuvants dispersed into the photographic elements, more particularly couplers, as well as the dyes formed from said couplers during the processing, have to be sufficiently resistant against the influence of light, increased temperature, and humidity. Furthermore, the photographic adjuvants dispersed with the aid of oil-formers must not give rise to fogging of the photosensitive silver halide emulsion.

Consequently, there is a continuing need for better oil-formers and for improved techniques of dispersing photographic adjuvants in photographic silver halide elements with the aid of such better oil-formers.

It is therefore an object of the present invention to improve the stability of dispersions of photographic adjuvants in photographic silver halide elements by the use of improved oil-formers and to enhance the stability and in particular the heat stability of the photographic record obtained by means of said photographic elements.

It is another object of the present invention to provide a photograpic silver halide element comprising in a photosensitive or in a non-photosensitive layer photographic adjuvants dispersed in a hydrophilic colloid with the aid of said improved oil-formers.

Other objects of the present invention will become apparent from the disclosure herein.

The above objects are accomplished by the use of high-boiling substantially water-insoluble oil-formers of the class of dihydroxymethyl(5,2,1,$0^{2,6}$)tricyclodecane and carboxylic, phosphoric, or phosphonic di-ester derivatives thereof in the preparation of dispersions of photographic adjuvants in hydrophilic colloid compositions.

According to the present invention there is thus provided a method of dispersing photographic adjuvants in hydrophilic colloid compositions for forming a water-permeable photosensitive or non-photosensitive colloid layer of a photographic silver halide element, said photographic adjuvants being dispersed with the aid of at least one high-boiling substantially water-insoluble oil-former of the class of dihydroxymethyl(5,2,1,$0^{2,6}$)tricyclodecane and carboxylic, phosphoric, or phosphonic di-ester derivatives thereof corresponding to the following general formula:

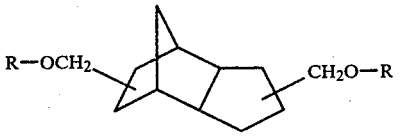

wherein: R represents hydrogen, or one of the following groups

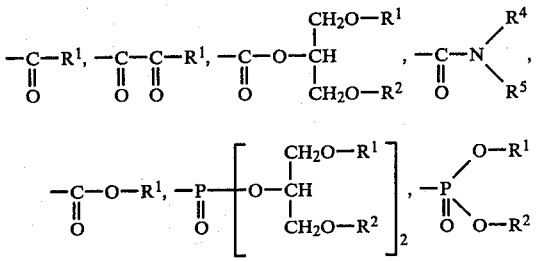

with carboxy or carboxyalkyl e.g. 1-carboxymethyl-3-heptadecenyl, a cycloalkenyl group, an aryl group e.g. phenyl or a substituted aryl group or a heterocyclic group, each of $R^4$ and $R^5$ (the same or different) representing a hydrogen atom or having one of the significances given for $R^1$, $R^2$, and $R^3$, or $R^4$ and $R^5$ may together represent the atoms necessary to complete a heterocyclic group.

The present invention also provides a photographic silver halide element comprising in a photosensitive or in a non-photosensitive layer photographic adjuvants that have been dispersed in a hydrophilic colloid composition with the aid of at least one high-boiling substantially water-insoluble oil-former of the class of dihydroxymethyl(5,2,1,$0^{2,6}$)tricyclodecane and carboxylic, phosphoric, or phosphonic di-ester derivatives thereof corresponding to the above general formula.

Representative examples of said oil-formers of the class of dihydroxymethyl(5,2,1,$0^{2,6}$)tricyclodecane and carboxylic, phosphoric, or phosphonic di-ester derivatives thereof corresponding to the above general formula are given in the following table 1. It is to be understood, however, that the invention is not limited to these specifically mentioned compounds. The symbole R used in said table 1 is the same as that used in the above general formula.

TABLE 1

| Oil-former | R | Molecular weight | Boiling at |
|---|---|---|---|
| 1 | $nC_4H_9—CH(C_2H_5)—CO—$ | 448 | 193–201° C./0.1 mm Hg |
| 2 | $CHFCl—CF_2—CO—$ | 485 | 186° C./0.8 mm Hg |
| 3 | $CF_3CF_2CF_2—CO—$ | 588 | 125° C./0.3 mm Hg |
| 4 | 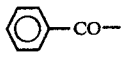 | 404 | 240° C./0.05 mm Hg |
| 5 | $CH_2=C(CH_3)—CO—$ | 332 | not determined |
| 6 | $nC_{13}H_{27}CH=CHCH_2—CH(CH_2—COOH)—CO—$ | 840 | not determined |
| 7 | 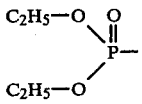 | 468 | 200° C./0.001 mm Hg |
| 8 | hydrogen | 196 | 175° C./1 mm Hg |

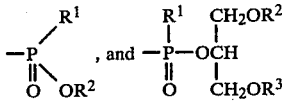

each of $R^1$, $R^2$, and $R^3$, which may be the same or different when present together, representing an alkyl group e.g. ethyl, propyl, butyl, 1-ethylpentyl, or a substituted alkyl group e.g. substituted with halogen atoms, carboxy, or carboxyalkyl e.g. perfluoropropyl, trifluorochloroethyl, a cycloalkyl group, an alkenyl group e.g. isopropenyl or a substituted alkenyl group e.g. an alkenyl group substituted As described in Chemiker Zeitung 98 (1974) p. 70–76 the above di-ester derivatives can be prepared by esterification of dihydroxymethyl-tricyclo(5,2,1,$0^{2,6}$)decane, which itself can be prepared by catalytic hydrogenation of the corresponding tricyclodecane (TCD) aldehyde on carrier contacts in the fixed bed process. The TCD-aldehydes can be prepared by oxosynthesis and isolated by fractional distillation.

For illustrative purposes the preparation of some of the oil-formers of table 1 is given hereinafter. The preparation of the other oil-formers of table 1 and of compounds not listed therein but corresponding to the general formula can be derived easily from the preparation examples given hereinafter and will not cause difficulties to those skilled in the art of preparative organic chemistry.

Preparation 1: oil-former no. 1

196 g (1 mol) of 4,8-dihydroxymethyl-tricyclo(5,2,1,$0^{2,6}$)decane, 317 g (2.2 mol) of 2-ethylhexanoic acid, 10 g of p-toluenesulphonic acid, and 1 l of anhydrous xylene were stirred and heated.

By means of a Dean-Stark apparatus 34.5 ml of water was collected in 3 h. The reaction mixture was rinsed twice with water. The xylene layer was dried and concentrated by evaporation. Fractional distillation using a Vigreux column gave 371 g (82.8%) of colourless to light-brown oil boiling at 193°–201° C./0.1 mm Hg.

Preparation 2: oil-former no. 5

49 g (0.25 mol) of 4,8-dihydroxymethyl-tricyclo(5,2,1,$0^{2,6}$)decane, 0.5 g of 2,6-di-t-butylphenol, and 350 ml of anhydrous methylene chloride were heated for 30 min at 35° C. An amount of 60 ml of pyridine was added to the mixture, which was kept at 35° C. until a light-yellow solution was obtained.

49 g (0.5 mol) of methacryloyl chloride was added dropwise to the solution, the reaction temperature being kept below 0° C. The resulting precipitate was filtered off and the filtrate obtained was rinsed twice with icewater. The methylene chloride layer was dried and concentrated by evaporation. The brown oil was extracted thrice with ether. The ether was then evaporated. An amount of 21.5 g of light-yellow oil was obtained, which was stabilized with 1 g of hydroquinone.

Preparation 3: oil-former no. 6

39.2 g (0.2 mol) of 4,8-dihydroxymethyl-tricyclo(5,2,1,$0^{2,6}$)decane, 128.8 g (0.4 mol) of hexadecenyl succinic anhydride, and 200 ml of anhydrous xylene were stirred for 5 h 30 min at boiling temperature. The xylene was evaporated. The resulting oil (160 g) was stirred in 500 ml of hot acetonitrile and then separated at room temperature, the solvent being removed by evaporation under reduced pressure. An amount of 143 g (85.2%) of light-yellow viscous oil was obtained.

The present invention is valuable for dispersing, in hydrophilic colloid compositions e.g. light-sensitive silver halide emulsions, with the aid of the oil-formers of the general formula, hydrophobic couplers such as:

couplers forming a cyan dye
couplers forming a magenta dye
couplers forming a yellow dye
couplers forming a black dye
competing couplers forming colourless compounds
development-inhibitor-releasing (DIR) couplers
coloured couplers According to the invention it is possible to improve the stability, more particularly the light and heat stability of the dye record obtained in a photographic element comprising a coupler as defined above and dispersed with the aid of at least one of the above oil-formers. The colour fog measured after development of the photographic elements according to the invention may also be significantly lower than that of analogous photographic elements comprising the same couplers but dispersed with classical oil-formers.

According to a preferred embodiment of the invention the oil-formers of the general formula can be used advantageously for dispersing in hydrophilic colloid compositions dye-forming couplers capable of forming quinone imine dyes having an absorption peak in the infrared portion of the spectrum, which dyes are particularly suited for forming integral infrared-absorbing sound tracks in colour photographic elements, especially in colour motion picture projection films.

The desirability of using dye sound tracks in colour motion picture projection films, particularly dye sound tracks that are compatible with projection equipment now in use and designed for films with silver sound tracks, has been recognized widely. However, the subtractive dyes forming the colour image have a maximum absorption between about 400 and 700 nm and are relatively transparent in the infrared region (800 nm plus or minus 50 nm), in which the S-1 photocells used in projection equipment have their optimum sensitivity. The search for dyes suitable for forming good infrared-absorbing sound tracks in colour motion picture projection films regretfully resulted in dyes lacking sufficient peak absorption and/or having too narrow an absorption peak for covering the range from about 750 to about 850 nm. In recent years, however, it has been established that specific combinations of certain dye-forming couplers with certain oil-formers in specific coupler to oil-former ratios offered a solution to these problems on condition that the quinone imine dyes obtained therewith had been formed partly or wholly in microcrystalline form.

It was found indeed that the absorption of quinone-imine dyes, which had been formed at least partly in microcrystalline form, showed a bathochromic shift. In fact the absorption curve appeared to have broadened and it showed a peak in the infrared region between 750 en 850 nm, to which the above-mentioned S-1 photocells respond optimally.

According to this above-said preferred embodiment of the present invention a combination of the oil-formers of the general formula with dye-forming couplers capable of forming microcrystalline quinone imine dyes for infrared-absorbing sound tracks may offer results that are superior to those obtained with combinations of known oil-formers and said known dye-forming couplers. The combination in accordance with the invention makes it possible to reduce the amount of coupler. It was also found that said combination gives improved stability particularly heat stability to the quinone imine dyes obtained.

Details on the formation of integral infrared-absorbing sound tracks in photographic elements as well as on couplers used therefor and on the infrared-absorbing quinone imine dyes obtained therewith as coupling product in a separate layer of such photographic elements during the same processing step as the one wherein the colour image is formed, can be found in U.S. Pat. Nos. 4,178,183; 4,233,389; 4,250,251 and in the Research Disclosures 18 732 (November 1979) p. 634–638; 15 125 (November 1976) p. 24–25; 13 460 (June 1975) p. 50.

The couplers for forming microcrystalline infrared-absorbing quinone imine dyes can be incorporated into a layer of the sound-recording layer structure making part of a sound- and picture-recording photographic colour element. Such element consists e.g. of sound-recording layer(s) coated on top of the picture-recording layers. A preferred layer composition of a picture-recording colour element comprises in order of sequence: a film support, the blue-sensitive silver halide emulsion layer(s) containing yellow-forming colour coupler(s), (an) intermediate layer(s), the panchromatic silver halide emulsion layer(s) containing cyan-forming colour coupler(s), (an) intermediate layer(s), and the orthochromatic silver halide emulsion layer(s) containing magenta-forming colour coupler(s). The sound-recording layer(s) can be coated on top of the orthochromatic layer(s) or on a protective layer covering the uppermost orthochromatic layer. The sound-recording layer(s) should have a spectral or general sensitivity such that they do not form an image upon image-wise exposure of the underlying picture-recording layers. Consequently, different sound-recording silver halide compositions are possible. For instance, the sound-recording silver halide emulsion can be sensitive to ultraviolet radiation and—to prevent the ultraviolet radiation from affecting the underlying picture-recording layers—an ultraviolet absorber is provided in a separate layer between the uppermost orthochromatic layer and the sound-recording silver halide emulsion layer, or the ultraviolet absorber is provided in the orthochromatic layer itself.

The response of this sound-recording layer to light during the image-wise exposure of the photographic colour element can be avoided by using filters or by the use of fine-grained ultraviolet-sensitive silver halide emulsions.

Alternatively the sound-recording layer can be sensitive to infrared radiation or very poorly sensitive to radiation between 470 and 500 nm so that during the image exposure of the colour element the sound-recording layer does not respond. According to these alternatives the sound-recording layer can be coated directly on the uppermost orthochromatic layer or on a protective or intermediate layer applied thereto.

According to another alternative the sound-recording layer can be sensitive to the green spectral region, but to a far less extent than the orthochromatic layer so that during the image exposure of the colour element the sound-recording layer does not respond.

According to a further alternative the sound-recording layer can be sensitive to the blue spectral region, but to a far less extent than the blue-sensitive layer(s) containing the yellow-forming colour couplers so that during the image exposure of the colour element the sound-recording layer does not respond. The blue-sensitive sound recording layer, which can e.g. be a fine-grain silver chlorobromide emulsion sensitive in the spectral range from 400 to 470 nm, may comprise a cyan-forming coupler in addition to the coupler forming an infrared-absorbing dye and it may even comprise (a) bleach-inhibitor-releasing compound(s).

According to all these above-mentioned embodiments the sound-recording layer contains the couplers for forming infrared-absorbing dye sound tracks.

According to a different embodiment the sound- and picture-recording photographic colour element comprises in order of sequence: a film support, the blue-sensitive silver halide emulsion layer(s) containing yellow-forming colour coupler(s), (an) intermediate layer(s), the panchromatic silver halide emulsion layer(s) containing cyan-forming colour coupler(s), (an) intermediate layer(s), the sound-recording silver halide emulsion layer(s) containing coupler(s) forming infrared-absorbing dye(s), (an) intermediate layer(s), the orthochromatic silver halide emulsion layer(s) containing magenta-forming colour couplers, and if desired (an) antistress layer(s). According to this embodiment the sound-recording silver halide emulsion layer(s) containing coupler(s) forming infrared-absorbing dye(s) is (are) sensitive in the blue spectral region from 400 to 470 nm, but is (are) far less sensitive than the blue-sensitive silver halide emulsion layer(s) containing the yellow-forming colour coupler(s), and it may contain in addition to the coupler(s) forming infrared-absorbing dye(s) (a) cyan-forming colour coupler(s) and, if desired, also (a) bleach-inhibitor-releasing compound(s). The silver halide of this (these) sound-recording emulsion layer(s) may be silver chlorobromide, preferably fine-grain silver chlorobromide.

According to another different embodiment the sound- and picture-recording colour element does not encompass a separate sound-recording layer that contains the couplers forming infrared-absorbing dyes. Instead thereof the latter couplers can be incorporated e.g. together with magenta-forming coupler(s) into the orthochromatic layer(s). However, the coupling speed of the magenta-forming couplers should then substantially exceed the coupling speed of the couplers forming the sound track dyes, so that in case of a normal image-wise exposure, the latter couplers, which are slow-coupling, cannot be affected as a result of insufficient amounts of oxidized developer. During the intensive sound track exposure both kinds of couplers respond and form their respective dyes, but the S-1 photocells only react to the infrared density obtained.

According to all above-mentioned embodiments the uppermost emulsion layer may, of course, be protected by (an) antistress layer(s).

Further details on layer structures of sound- and picture-recording colour elements can be found in U.S. Pat. Nos. 3,705,799-3,705,801-3,737,312, and 4,208,210; in DE-OS No. 2,302,661; in UK Pat. Nos. 1,411,311-1,429,108, and in the Research Disclosure 18 732 (November 79) p. 634–38.

Dihydroxymethyl-tricyclodecane and the carboxylic, phosphoric, or phosphonic di-ester derivatives thereof according to the general formula, when used as oil-formers in preparing dispersions of photographic adjuvants i.a. couplers and said dye-forming couplers capable of forming quinone imine dyes e.g. the dye-forming couplers described in the above-mentioned references, in hydrophilic colloid compositions to be coated as a photographic layer e.g. a silver halide emulsion layer or another hydrophilic colloid layer making part of a photographic element e.g. a motion picture projection colour film, prevent the diffusion of said couplers or dye-forming couplers into adjacent water-permeable layers and impart excellent thermal and light stability to the azomethine or quinone imine dyes obtained therewith. Moreover, said couplers or said dye-forming couplers remain sufficiently accessible to the developing and other processing solutions, as is clearly demonstrated by the high colour densities obtained upon colour development.

The oil-formers according to the general formula can also be employed in dispersing dyes e.g. filter dyes, antihalation dyes, sensitizing dyes, light-screening dyes, as well as dye-releasing compounds, stabilizers, UV-absorbers, optical brightening agents, electron-donating agents, scavengers, fluorescing compounds, etc. in hydrophilic colloid compositions for forming a photographic layer e.g. a silver halide emulsion layer or another hydrophilic colloid layer of a photographic element. Of course, the oil-forming derivatives according to the general formula can also be used in dispersing mixtures of different photographic adjuvants e.g. mixtures of different couplers.

The photographic adjuvants, which are dispersed with the aid of the oil-formers of the general formula, usually have a solubility in water of at most 3% by weight at 20° C.

In accordance with the invention the oil-formers according to the general formula can be used in widely varying concentrations e.g. in amounts ranging from about 0.1 to about 10 parts by weight and preferably from 0.5 to 2 parts by weight relative to the amount of photographic adjuvant dispersed therewith.

It is possible also to use as oil-former for dispersing photographic adjuvants as hereinbefore disclosed a combination of different oil-formers corresponding to the above general formula or a combination of at least one of said oil-formers with at least one of other known oil-formers such as alkyl esters of phthalic acid, e.g. dimethyl phthalate, diethyl phthalate, di-n-butyl phthalate, di-i-amyl phthalate, dihexyl phthalate, diheptyl phthalate, dioctyl phthalate, dinonyl phthalate, didecyl phthalate, n-amyl phthalate, dibutylmonochlorophthalate, butylphthalylbutyl glycolate, 2,4-di-n-amylphenol, 2,4-di-tert-amylphenol, phosphoric acid esters e.g. diphenyl phosphate, triphenyl phosphate, tri-o, m-, or p-cresyl phosphate, o-cresyl diphenyl phosphate, dioctyl phosphate, di-octyl butyl phosphate, tri-n-octyl phosphate, tri-n-decyl phosphate, trixylenyl phosphate, tris-(isopropylphenyl)phosphate, tributyl phosphate, trihexyl phosphate, trinonyl phosphate, trioleyl phosphate, tris-(butoxyethyl)phosphate, citric acid esters e.g. 0-acetyltriethyl-(or butyl-, hexyl-, octyl-, nonyl-, or decyl)-citrate, benzoic acid esters e.g. butyl- (or hexyl-, heptyl-, octyl-, nonyl-, decyl-, undecyl-, dodecyl-, tridecyl-, tetradecyl-, hexadecyl-, octadecyl-, oleyl-, etc.) benzoate, n-butyl-2-methoxy benzoate, pentyl-o-methyl benzoate, decyl-p-methyl-benzoate, octyl-o-chlorobenzoate, lauryl-p-chlorobenzoate, propyl-2,4-dichlorobenzoate, octyl-2,4-dichlorobenzoate, stearyl-2,4-dichlorobenzoate, oleyl-2,4-dichlorobenzoate, octyl-p-methoxybenzoate, fatty acid esters e.g. hexadecyl myristate, dibutoxyethyl succinate, dioctyl adipate, dioctyl azelate, decamethylene-1,10-diol diacetate, triacetin, tributyrin, benzyl caprate, pentaerythrite tetracapronate, isosorbide dicaprylate, amides, e.g. N,N-dimethyl lauramide, N,N-diethyl lauramide, N,N,di-n-butyl lauramide, N-butylbenzene sulphonamide, trioctyl trimellitate, chlorinated paraffins, aliphatic esters of glycerol and derivatives thereof e.g. glycerol triacetate, ethers e.g. allyl ether, or those oil-formers described in i.a. U.S. Pat. Nos. 2,304,940; 2,322,027; 2,353,262; 2,533,514; 2,801,170; 2,801,171; 2,835,579; 2,852,383; 2,949,360; 3,287,134; 3,554,755; 3,700,454; 3,748,141; 3,767,142; 3,779,765; 3,788,857; 3,837,863; 3,936,303; 4,004,928; 4,075,022; 4,106;940; 4,178,183; 4,233,389; 4,250,251; in UK Pat. Nos. 958,441; 1,222,753; 1,272,561; 1,424,454; 1,501,233; 2,027,130; in DE OS Nos. 2,432,041; 2,538,889; 2,613,504; 2,629;842; 2,903,681; 2,909,402; 2,932,368; in DE P 1,152,610; in JA P 23233/71; 29461/74; 28693/77; 15127/78; 1521/78, in JA Pat. Publications 34715/77; 82078/75; 26037/76; 27921/76; in BE Pat. Nos. 768,585 and 833,202, and in the Research Disclosures 18732 (Nov. 1979) p. 634–38 and 16745 (March 1978) p. 58–59.

It may be useful to combine oil-formers corresponding to the above general formula and, if desired, at least one known oil-former described or referred to above, with at least one auxiliary solvent being not or almost not soluble in water and having a boiling point of at most 150° C., such as lower alkyl acetates e.g. methyl acetate, ethyl acetate, n-propyl acetate, isopropyl acetate, butyl acetate, ethyl formiate, methyl propionate, ethyl propionate, carbon tetrachloride, sym-dichloroethylene, trichloroethylene, 1,2-dichloropropane, chloroform, amyl chloride, diethyl carbonate, diethyl ketone; methyl ethyl ketone, methyl-n-propylketone, diethyl ketone, diisopropyl ether, cyclohexane, methylcyclohexane, ligroin, benzene, toluene, xylene, nitromethane. The auxiliary solvent may also be a water-soluble organic solvent such as methanol, ethanol, isopropylalcohol, dimethylsulphoxide, tetrahydrofuran, N-methylpyrrolidone, dioxan, acetone, butyrolactone, ethylene glycol, ethylene glycol monomethyl ether, ethylene glycol monoethyl ether, ethylene glycol monobutyl ether, diethylene glycol monoethyl ether, diethylene glycol monomethyl ether, glycerol, acetonitrile, formamide, dimethylformamide, tetrahydrothiophene dioxide, dimethoxyethane. The auxiliary solvent may also be one described in i.a. U.S. Pat. Nos. 2,801,170; 2,801,171; 2,949,360; 2,835,579.

Although in the making of dispersions of photographic adjuvants in hydrophilic colloid compositions in accordance with the invention gelatin is favoured as hydrophilic colloid, other water-soluble colloidal substances or mixtures of these can be used too e.g. colloidal albumin, starch, zein, alginic acid and derivatives thereof, such as salts, esters, and amides, casein, cellulose derivatives such as carboxymethyl cellulose, synthetic hydrophilic colloids such as polyvinyl alcohol, poly-N-vinyl pyrrolidone, anionic polyurethans, copolymers of acrylic esters, acrylonitrile, and acrylamides, etc.

During the manufacture of the photographic silver halide element according to the invention, the non-diffusing photographic adjuvants can be incorporated in the presence of the oil-formers according to the above general formula into the coating composition of the silver halide emulsion layer(s) or other colloid layer(s) in water-permeable relationship therewith according to any technique known by those skilled in the art of incorporating photographic adjuvants, more particularly couplers, into colloid compositions.

For more details about particularly suitable techniques that can be employed for dispersing photographic adjuvants in accordance with the invention into hydrophilic colloid compositions there can be referred to U.S. Pat. Nos. 2,304,939; 2,304,940; 2,322,027; 2,801,170; 2,801,171 and 2,949,360.

The photographic adjuvants can be dispersed in the presence of a surface-active agent or dispersing agent. The surface active agent used may be of the ionic, non-ionic or amphoteric type. Examples of suitable ionic surface-active agents are the sodium salt of oleylmethyltauride, sodium stearate, 2-heptadecyl-benzimidazole-5-sulphonic acid sodium salt, sodium sulphates of aliphatic alcohols containing more than 5 carbon atoms per molecule, e.g. 2-methylhexanol sodium sulphate; the sodium salt of di-isooctyl ester of sulphonated succinic acid, sodium dodecyl sulphate and p-dodecylbenzene sulphonic acid sodium salt. Examples of suitable non-ionic surface-active agents are saponine, condensation products of ethylene oxide and alkyl phenols, e.g. p-octylphenol and p-isononyl phenol and phenylethylene glycol oleate. Other examples of anionic and non-ionic surface-active agents can be found in UK Pat. No. 1,460,894.

A survey of wetting agents, representatives of which can be used in the method of the present invention are described by Gerhard Gawalek "Wash- und Netzmittel" Akademieverlag, Berlin (1962).

It is also possible to use mixtures of anionic and nonionic surface-active agents as described e.g. in UK Pat. No. 1,460,894.

Other suitable wetting agents are the fluorine-containing surface-active agents of U.S. Pat. No. 3,292,402.

The photosensitive silver halide emulsions used in the making of photographic elements according to the present invention can be sensitized chemically as well as optically. They can be sensitized chemically by carrying out the ripening in the presence of small amounts of sulphur-containing compounds such as allyl thiocyanate, allyl thiourea, or sodium thiosulphate. The emulsions can also be sensitized by means of reducing agents e.g. tin compounds as described in FR Pat. No. 1,146,955 and in BE Pat. No. 568,687, imino-aminomethane sulphinic acid compounds as described in UK Pat. No. 789,823 and small amounts of noble metal compounds such as gold, platinum, palladium, iridium, ruthenium, and rhodium compounds. They can be sensitized optically by means of cyanine and merocyanine dyes.

The photosensitive silver halide emulsions used in the making of photographic elements according to the present invention can be sensitized to one of the regions of the visible spectrum, to the ultraviolet region of the spectrum, or to the infrared region of the spectrum.

The emulsions can also comprise compounds that sensitize the emulsions by development acceleration e.g. compounds of the polyoxyalkylene type such as alkylene oxide condensation products as described i.a. in U.S. Pat. Nos. 2,531,832-2,533,990, in UK Pat. Nos. 920,637; 940,051; 945,340; 991,608 and 1,091,705, onium derivatives of amino-N-oxides as described in UK Pat. No. 1,121,696, and thioethers as described in U.S. Pat. No. 4,929,400.

Further, the emulsions may comprise stabilizers e.g. heterocyclic nitrogen-containing thioxo compounds such as benzothiazoline-2-thione and 1-phenyl-2-tetrazoline-5-thione and compounds of the hydroxytriazolopyrimidine type. They can also be stabilized with an aromatic or heterocyclic mercapto compound as described in the UK Pat. No. 39457/80 or with mercury compounds such as the mercury compounds described in BE Pat. Nos. 524,121; 677,337, and in the UK Pat. No. 1,173,609.

The light-sensitive emulsions containing photographic adjuvants e.g. couplers in accordance with the invention may also comprise any in Research Disclosure no. 17 643 of December 1978.

The emulsions can be coated on a wide variety of photographic emulsion supports. Typical supports include cellulose ester film, polyvinylacetal film, polystyrene film, polyethylene terephthalate film and related films or resinous materials, as well as paper e.g. polyethylene-coated paper and glass.

For the production of photographic colour images with a photographic element according to the invention an exposed silver halide emulsion layer is developed with an aromatic primary amino developing substance in the presence of (a) coupler(s) as mentioned above. All colour developing agents capable of forming azomethine or quinone imine dyes can be utilized as developers. Suitable developing agents are aromatic compounds in particular p-phenylenediamine and derivatives thereof, e.g. N,N-dialkyl-p-phenylenediamines, N,N-dialkyl-N'-sulphomethyl-p-phenylenediamines, N,N-dialkyl-N'-carboxymethyl-p-phenylenediamines, the sulphonamido-substituted p-phenylenediamines disclosed in U.S. Pat. No. 2,548,574 and other substituted p-phenylenediamines disclosed in U.S. Pat. No. 2,566,271.

Typical examples of p-phenylenediamines are N,N-diethyl-p-phenylenediamine, 2-amino-5-diethylaminotoluene, N-butyl-N-sulphobutyl-p-phenylenediamine, 2-amino-5-[-N-ethyl-N-(β-methylsulphonamido)-ethyl]aminotoluene, N-ethyl-N-β-hydroxyethyl-p-phenylenediamine, etc. These developing agents are often used in their salt form e.g. as hydrochloride or sulphate.

The following examples illustrate the present invention.

EXAMPLE 1

A series of analogous dispersions were made of the cyan-forming coupler according to the structural formula:

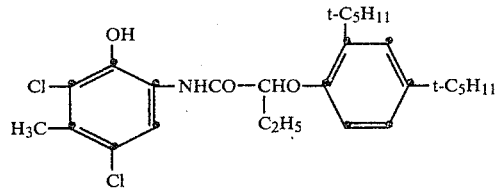

with the aid of oil-formers 1,2,3, and 4 of table 1 and, for comparison purposes, also with the following known oil-formers A, B, and C:

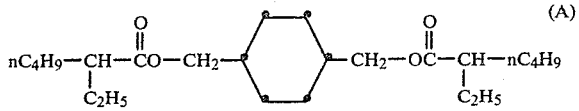

as described in U.S. Pat. No. 3,748,141;

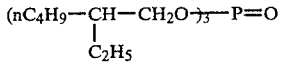

as described in DE-OS No. 2,909,402; and tricresyl phosphate

The coupler was dispersed each time in an aqueous gelatin medium according to the following technique.

83 ml of 5% aqueous gelatin was mixed with 5 to 10% of an emulgator based on the weight of the gelatin. The mixture was dispersed at 40° C. Within 30 s a solution of 6 mmol of the colour coupler and an amount of oil-former corresponding to the ratios listed in tables 2 and 3 hereinafter in 18 to 36 ml of ethyl acetate were added with stirring. Then the acetic ester was removed from the mixture by bringing the latter into a rotating thin-layer evaporator at 60° C. and about 5 kPa.

110 g of a red-sensitized silver bromo-iodide emulsion (with 2.3% iodide) having a gelatin content of 85.8 g per kg and a silver halide content corresponding to 50 g of silver nitrate per kg was mixed in molten state with 154.4 g of 7.5% aqueous gelatin, whereupon 100 ml of water was added.

The mixture was left at 40° C. for 1 h and next the above coupler dispersion was added with stirring together with the usual additives such as hardeners, wetting agents and stabilizers. Finally water was added up to a total weight of 575 g.

The resulting coating solution was coated on a cellulose triacetate support at a ratio of 125 g per sq.m.

After exposure to light of the appropriate wavelength through a grey wedge, the photographic elements obtained were developed at 24° C. for 10 min in a colour developing bath of the following composition:

2 g of sodium hexametaphosphate
4 g of anhydrous sodium sulphite
17 g of anhydrous sodium carbonate
2 g of potassium bromide
3 g of 2-amino-5-diethylaminotoluene hydrochloride, and water to make 1 l.

Subsequently the developed elements were treated at 24° C. for 5 min in the following acid fixing bath:

800 ml of water
200 g of anhydrous sodium thiosulphate (or 300 g of sodium thiosulphate pentahydrate)
12 g of potassium hydrogen sulphite
12 ml of glacial acetic acid
20 g of borax
15 g of potassium alum, and water to make 1 l.

The elements were rinsed with water (21° C.) for 10 min and subjected to a bleaching bath (21° C., 7 min) of the following composition:

20 g of potassium bromide
5 g of potassium dichromate
40 g of potassium alum, and water to make 1 l.

Subsequently, the elements were rinsed at 15° C. for 5 min and fixed again in the fixing bath mentioned above (at 24° C. for 5 min). After another rinsing at 15° C. for 10 min the materials were stabilized by immersion for 20 s in a stabilizing bath with the following composition:

1.8 ml of 5% saponin
12.8 ml of 40% formaldehyde water up to 1 l.

The strips of thus exposed and processed photographic elements were evaluated sensitometrically as to colour fog with a commonly used sensitometer.

Table 2 shows the coupler (in g) to oil-former (in ml) ratios of the different samples tested and the colour fog obtained therewith.

TABLE 2

| Oil-former | Ratio of coupler to oil-former | colour fog |
|---|---|---|
| 1 | 2:1 | 0.27 |
| 1 | 4:3 | 0.30 |
| 1 | 1:1 | 0.31 |
| 4 | 1:1 | 0.25 |
| 4 | 2:1 | 0.23 |
| A (comparison) | 1:1 | 0.37 |
| A (comparison) | 2:1 | 0.33 |
| C (comparison) | 1:1 | 0.47 |
| B (comparison) | 2:1 | 0.35 |
| B (comparison) | 1:1 | 0.34 |

As shown clearly by the results in table 2, the photographic elements comprising the oil-formers 1 and 4 according to the general formula excel by a significant decrease in colour fog as compared with that of the known oil-formers A, B and C.

The heat stability of the cyan azomethine dye images obtained was then tested in the usual manner at 77° C. and a relative humidity of 10% for 7 days. The loss in maximum density of the cyan image expressed in percent is reported in the following table 3.

TABLE 3

| Oil-former | Ratio of coupler to oil-former | loss of Dmax in % |
|---|---|---|
| 1 | 4:3 | −17 |
| 1 | 1:1 | −16 |
| 2 | 2:1 | −16 |
| 2 | 1:1 | −12 |
| 3 | 2:1 | −16 |
| 3 | 1:1 | −14 |
| 4 | 2:1 | −13 |
| 4 | 1:1 | −10 |
| A (comparison) | 1:1 | −17 |
| A | 2:1 | −22 |
| C | 1:1 | −26 |
| B | 2:1 | −27 |
| B | 1:1 | −27 |

It follows clearly from the results shown in table 3 that the heat stability of the dye images obtained with the photographic elements according to the invention is superior to that of the comparison elements.

EXAMPLE 2

The dye-forming coupler according to the structural formula:

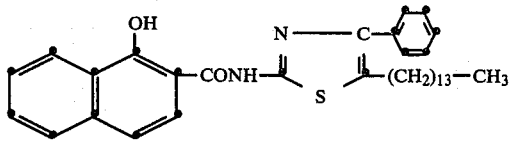

when coupling with the oxidized aromatic primary amino developing agent 2-amino-5-diethylamino-toluene hydrochloride, forms the infrared absorbing quinone imine dye corresponding to the formula:

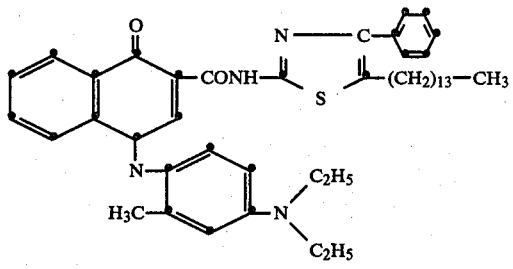

Three batches of the latter quinone imine dye were dispersed with the aid of 3 different oil-formers in different dye to oil-former ratios as defined hereinafter in table 4. The resulting dispersions were incorporated into a coating composition to form one single layer as outlined in example 1, but using the dye instead of the coupler and omitting the silver halide. The resulting film strips needed no development, of course.

The spectral data measured with a Perkin Elmer 555 spectrophotometer are listed in the following table 4. Maximum density and the absorption peak (λ max) as well as the density at 750 and 850 nm respectively are given.

TABLE 4

| Oil-former | Ratio of dye to oil-former in weight to volume | Dmax | λ max | D(750) | D(850) |
|---|---|---|---|---|---|
| dibutyl | 1:0.5 | 3.34 | 746 | 3.32 | 2 |

TABLE 4-continued

| Oil-former | Ratio of dye to oil-former in weight to volume | Dmax | λ max | D(750) | D(850) |
|---|---|---|---|---|---|
| phthalate | 1:1 | 3.86 | 722 | 3.59 | 2 |
| oil-former (A) | 1:0.5 | 3.98 | 834 | 3.75 | 3.85 |
| (see example 1) | 1:1 | 3.71 | 720 | 3.28 | 1 |
| oil-former 3 | 1:0.5 | 4.19 | 826 | 3.02 | 3.62 |
| | 1:1 | 4.41 | 820 | 3.11 | 3.62 |

Table 4 learns that:
(a) dibutyl phthalate in the concentrations used gives the poorest results,
(b) the bathochromic shift generally increases when the amount of oil-former decreases
(c) in the case of oil-former 3 used in accordance with the invention the concentration-dependence at λ max is far less pronounced. This oil-former 3 also shows a favourably broad peak absorption in the range from 750 to 850 nm.

EXAMPLE 3

Four strips of a clear film support were coated with a layer containing a dispersion of the dye-forming coupler identified in example 2 hereinbefore. All 4 film strips incorporated this same coupler though dispersed with the aid of different oil-formers in different coupler to oil-former ratios as defined in table 5 hereinafter. The dispersions and coatings were prepared according to the procedures outlined in example 1.

The strips were exposed through a step wedge having a constant of 0.5 and processed according to the procedure of example 1.

The sensitometric results obtained are listed in the following table 5. The 3 highest steps were measured. In the table W ½ represents the width in nm of the absorption curve at half the height of λ max. Densities above 5 could not be measured on the spectrophotometer used. λ max is in nm.

TABLE 5

| | Coupler to oil-former ratio | | | | | |
|---|---|---|---|---|---|---|
| | 4:1 | | | 2:1 | | |
| Oil-former | λ max | Dmax | W½ | λ max | Dmax | W½ |
| dibutyl phthalate | 808 | 4.1 | 192 | 780 | 3.6 | 214 |
| | 801 | 3.4 | 198 | 758 | 3.15 | 214 |
| | 764 | 2.15 | 214 | 742 | 2.45 | 206 |
| oil-former 1 | ... | >5 | ... | ... | >5 | ... |
| | 812 | 4.2 | 182 | 804 | 3.95 | 186 |
| | 788 | 2.5 | 206 | 772 | 2.41 | 208 |
| oil-former 8 | | | | 780 | 3.59 | 204 |
| | | | | 782 | 3.64 | 197 |
| | | | | 771 | 2.86 | 205 |

From the results in the table it is apparent that:
(a) the density at equal exposure (same step) generally increases as the coupler to oil-former ratio rises. At the same time bathochromy increases as well.
(b) oil-formers 1 and 8 of table 1 at equal exposure and equal coupler to oil-former ratio yield higher density values (with more bathochromic absorption maximum) than dibutyl phthalate. It ensues that the use of oil-formers according to the present invention permits the use of smaller amounts of coupler to obtain identical sound track densities.

We claim:

1. Method of dispersing photographic adjuvants in hydrophilic colloid compositions in the presence of one or more oil-formers, characterized in that at least one of said oil-formers is a high-boiling substantially water-insoluble oil-former of the class of dihydroxymethyl(5,2,1,$0^{2,6}$)tricyclodecane and carboxylic, phosphoric, or phosphonic di-ester derivatives thereof.

2. Method according to claim 1, characterized in that said oil-former corresponds to the following general structural formula:

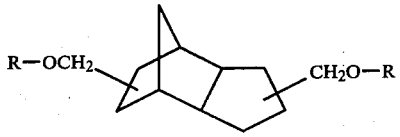

wherein: R represents hydrogen, or one of the following groups

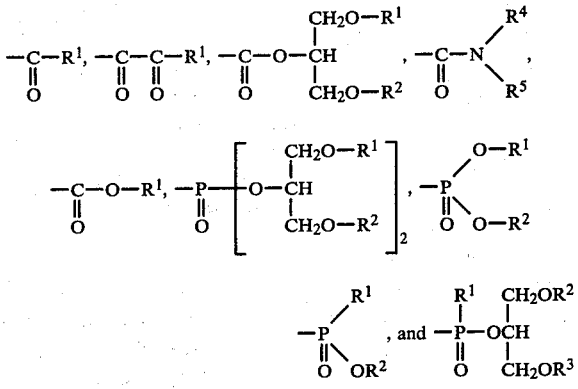

each of $R^1$, $R^2$, and $R^3$, which may be the same or different when present together, representing
an alkyl group or a substituted alkyl group
a cycloalkyl group,
an alkenyl group or a substituted alkenyl group,
a cycloalkenyl group,
an aryl group or a substituted aryl group, or
as heterocyclic group,
each of $R^4$ and $R^5$ (the same or different), representing a hydrogen atom or having one of the significances given for $R^1$, $R^2$, and $R^3$,
or $R^4$ and $R^5$ may together represent the atoms necessary to complete a heterocyclic group.

3. Method according to claim 1, characterized in that the ratio of oil-former to photographic adjuvant is in the range of 0.1:1 to 10:1.

4. Method according to claim 1, characterized in that said photographic adjuvant is a hydrophobic coupler capable of forming an azomethine dye or a quinone imine dye.

5. Method according to claim 4, characterized in that said hydrophobic coupler is a dye-forming coupler capable of forming a quinone imine dye having an absorption peak in the infrared portion of the spectrum.

6. Method according to claim 1, characterized in that said hydrophilic colloid composition is a coating composition for forming a photosensitive or non-photosensitive layer making part of a photographic silver halide element.

7. Photographic silver halide element comprising in a photosensitive silver halide emulsion layer or in a non-photosensitive layer photographic adjuvants dispersed in the hydrophilic colloid with the aid of one or more oil-formers, characterized in that at least one of said oil-formers is a high-boiling substantially water-insoluble oil-former of the class of dihydroxymethyl(5,2,1,$0^{2,6}$)tricyclodecane and carboxylic, phosphoric, or phosphonic di-ester derivatives thereof.

8. A photographic element according to claim 7, characterized in that said oil-former corresponds to the following general structural formula:

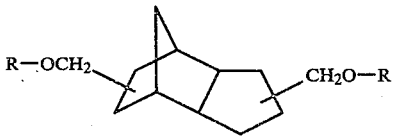

wherein: R represents hydrogen, or one of the following groups

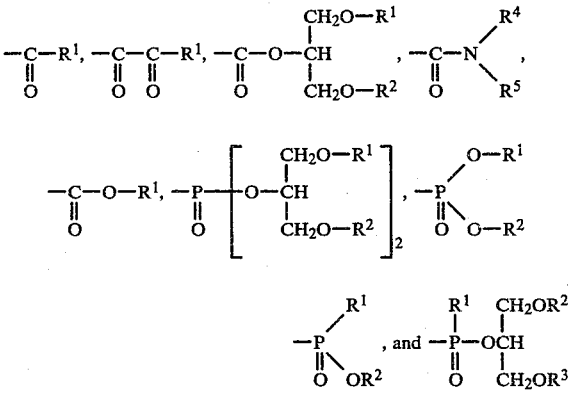

each of $R^1$, $R^2$, and $R^3$, which may be the same or different when present together, representing an alkyl group or a substituted alkyl group
a cycloalkyl group,
an alkenyl group or a substituted alkenyl group,
a cycloalkenyl group,
an aryl group or a substituted aryl group, or
a heterocyclic group, each of $R^4$ and $R^5$ (the same or different), representing a hydrogen atom or having one of the significances given for $R^1$, $R^2$, and $R^3$, or $R^4$ and $R^5$ may together represent the atoms necessary to complete a heterocyclic group.

9. A photographic element according to claim 7, characterized in that said photographic adjuvant is a hydrophobic coupler capable of forming an azomethine dye or a quinone imine dye.

10. A photographic element according to claim 9, characterized in that said hydrophobic coupler is a dye-forming coupler capable of forming a quinone imine dye having an absorption peak in the infrared portion of the spectrum.

11. A photographic element according to claim 10, characterized in that said photosensitive silver halide emulsion layer is a sound-recording layer, which is sensitive to the visible, infrared, or ultraviolet region of the spectrum.

* * * * *